United States Patent [19]

Crow

[11] Patent Number: 4,863,047

[45] Date of Patent: Sep. 5, 1989

[54] CONTAINER WITH SEAL AND CAP

[76] Inventor: Chet H. Crow, 215 Brookston Ct., Schaumburg, Ill. 60193

[21] Appl. No.: 260,575

[22] Filed: Oct. 27, 1988

[51] Int. Cl.[4] ..... B65D 41/62

[52] U.S. Cl. ..... 215/32; 220/258

[58] Field of Search ..... 215/32; 220/258; 222/541

[56] References Cited

U.S. PATENT DOCUMENTS

| | | | |
|---|---|---|---|
| 3,269,617 | 8/1966 | Goth | 222/541 |
| 3,282,477 | 11/1966 | Henchert | 222/541 |
| 3,416,712 | 12/1968 | Shastal | 215/32 X |
| 3,419,181 | 12/1968 | Stec | 220/258 |
| 3,495,746 | 2/1970 | Laurizio | 222/541 |
| 4,113,129 | 9/1978 | Cambio | 215/32 X |

*Primary Examiner*—Donald F. Norton

*Attorney, Agent, or Firm*—Robert J. Black

[57] ABSTRACT

A bottle for containment of motor oil or similar viscous material which includes contained therein a seal which prevents flow of the oil until the bottle is properly positioned over the oil receiving port at which time a device attached to the seal is operated to remove or puncture the seal in such a way as to permit the oil or similar material to flow from the bottle while avoiding the spillage usually associated with such containers.

8 Claims, 1 Drawing Sheet

CONTAINER WITH SEAL AND CAP

BACKGROUND OF THE INVENTION

1. Field of the Invention

The present invention pertains to containers such as motor oil bottles, and more particularly, to a bottle adapted to prevent spillage when oil or similar liquids are poured from a bottle.

2. Background Art

A long existing problem exists in the pouring of motor oil from containers usually utilized for such and similar materials into the opening of a crankcase intended for receipt of oil in automobile engines. Previously, motor oil was frequently sold in one quart cans which required special openers or funnels to prevent leakage onto the engine block of an automobile when oil was poured into the crankcase through the usual port opening. More recently, plastic bottles with elongated necks have been utilized as containers for automobile motor oil. However, spillage frequently occurs anyhow even with these containers unless a funnel is used because of placement of various components around the port to which the oil is deposited.

The only known attempt to overcome this spillage problem is disclosed in U.S. Pat. No. 4,696,328 which shows the utilization of the plastic bottles and utilizes a rupturable seal on the bottle. This arrangement as taught by the patent requires that a certain amount of air in addition to oil be included in the bottle prior to placement of seal and then the bottle is squeezed with the air forcing the rupturable seal to break when the bottle is properly positioned over the oil port of an automobile engine. While the arrangement shown may be an acceptable solution to the problem, it requires that a measured amount of air be included in the container and suffers from the possibility that the seal may become ruptured prior to utilization of the oil in the manner in which it was intended.

Accordingly, it is the purpose of the present invention to develop a new arrangement for use with plastic bottles containing motor oil or similar materials which overcomes the spillage problem without some of the noted drawbacks of the prior art.

SUMMARY OF THE INVENTION

The present invention provides a bottle that prevents spillage of the contents therein when the bottle is placed in position over the motor oil insertion port of an automobile engine or in similar environments where the bottle must be tilted to an almost vertical position. The bottle of the present invention is like that currently in use or similar to those currently in use for the containment of motor oil; that is, it has an elongated neck terminating in an opening wide enough to enable the motor oil or similar viscous liquid to pour from the bottle when the bottle is tilted up.

In the present arrangement an airtight seal is included within the neck of the bottle and secured to the perimeter of the neck to prevent liquid from being poured from the opening when the bottle is tilted. The seal may be of paper, foil-backed paper, or thin plastic, or any similar material which can be easily removed by means of a ring which may be grasped by the user and is attached either directly or by means of a short plastic cord to the seal. Normally prior to use the ring is placed on top of the seal and underneath the bottle cap normally supplied with the bottle of the present invention. Obviously the bottle cap has to provide the necessary room for the ring or similar device utilized to break or remove the seal so that the contents may be allowed to flow freely from the bottle of the present invention. Several embodiments, variations of the present invention are included, they are all derived from the basic concept presented herein.

DESCRIPTION OF THE PREFERRED EMBODIMENT

Figure 1:
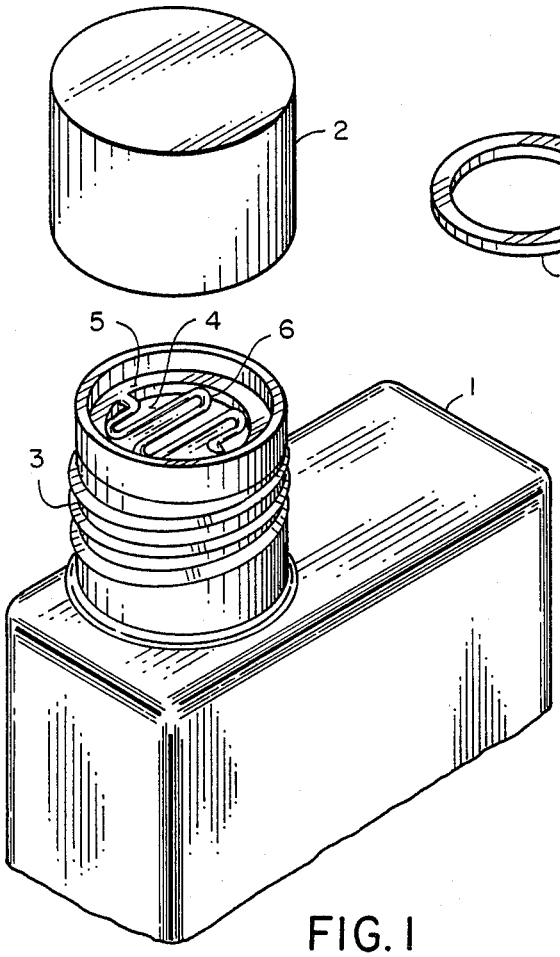
FIG. 1 is an exploded partial perspective view of a bottle for motor oil or similar liquids showing the bottle cap removed with the associated components located within the neck of the bottle, in accordance with the present invention.

Referring first to FIG. 1, a bottle 1 in accordance with the present invention is partially shown with the cap 2 removed. The only special requirement for the cap (or any similar external cover) is that adequate space be provided on the inside so as to insure those components which are nested within the neck of the container are not fractured or injured in any way. As can be seen by reference to FIG. 1 again, the seal 4 is contained within the neck 3 of the bottle and provides a liquid proof seal to the contents contained within the bottle. Nested within the neck of the bottle and on top of seal 4 is a ring 5 connected by means of small plastic cord 6 to the seal 4. It is with the components located in this position that the container is normally shipped to the user.

Figure 2:
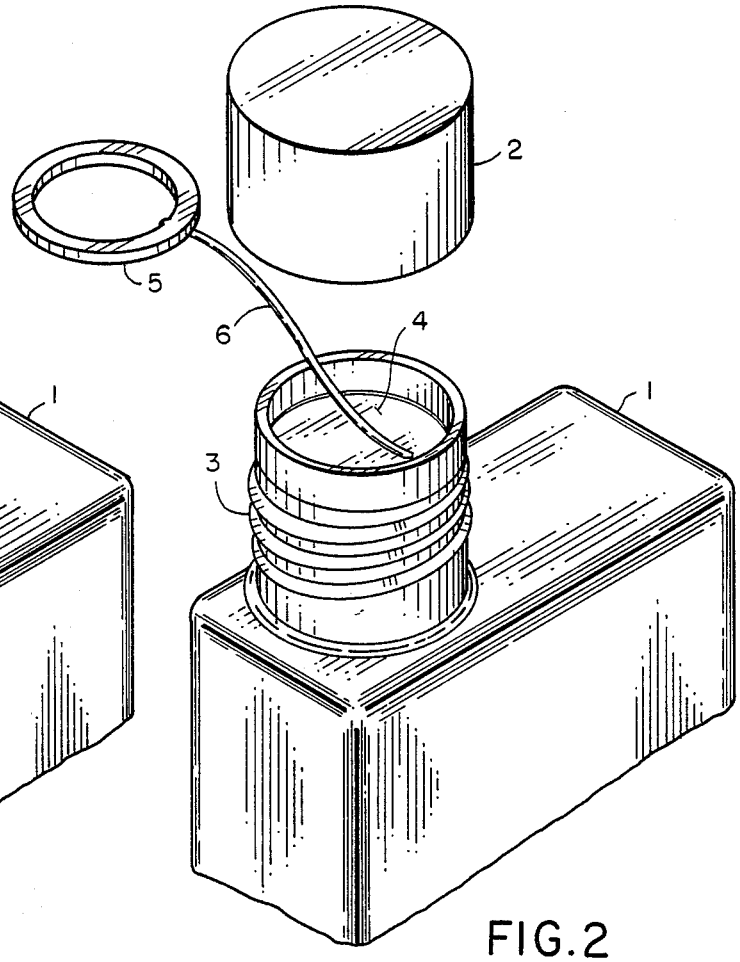
FIG. 2 is a partial perspective view of a bottle in accordance with the present invention showing the seal and components therein in the proper position just prior to operation.

Referring now to FIG. 2, the user, in preparation for pouring the contents of the bottle into an automobile engine or similar environment, removes the cap 2 from the bottle and then grasping ring 5 extracts ring 5 and cord 6 from their position within the neck 3 of the bottle. The bottle is then inverted and placed with the neck over the port into which the oil or similar material is to be placed and the ring 5 is grasped and pulled to remove or fracture the seal 4 from its location within the neck 3 of the bottle allowing the contents therein to flow freely out of the neck 3 of the bottle into the engine port or similar location wherever so desired.

Figure 3:
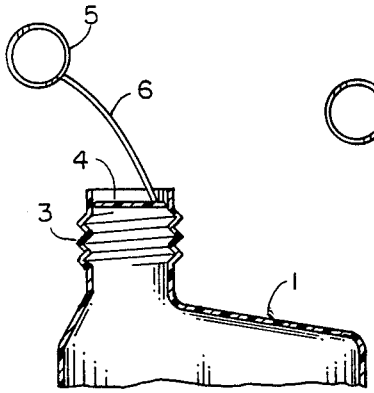
FIG. 3 is a partial sectional view taken through the midpoint of the bottle of the present invention showing the seal in position with the ring and cord positioned just prior to opening of the container.
Figure 4:
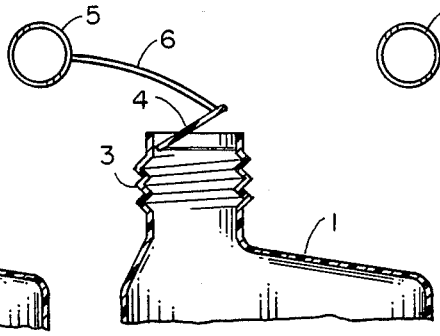
FIG. 4 is a partial sectional view taken along the midpoint of the bottle in accordance with the present invention showing the seal after opening.

Locations of the components are also seen both before and after rupturing of the seal by references to FIGS. 3 and 4.

Figure 5:
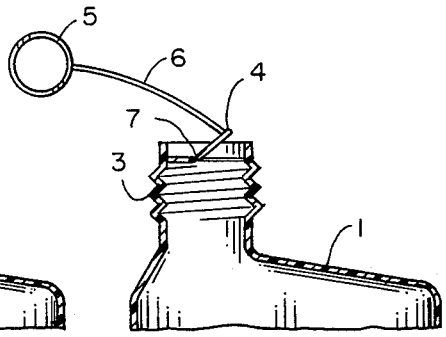
FIG. 5 is a partial sectional view taken along the midpoint of the bottle showing an alternate form of the seal where a hinge portion is included in the seal and after operation a portion of the seal remains attached to the internal portion of the neck of the bottle.

A modification of the present invention is shown in FIG. 5 wherein the seal includes a hinged portion 7 like that shown in FIG. 5. When the ring 5 is pulled, cord 6 acts only on a portion of the seal and the oil flow freely at that portion of the seal which is removed from its position in the neck as shown in FIG. 5. In this arrangement the seal, cord and ring remain attached to the oil bottle and thus can be disposed of as a single entity. This arrangement may be desirable from an environmental standpoint where a tendency might be to drop or otherwise not dispose of the ring, cord and seal properly.

Figure 6:
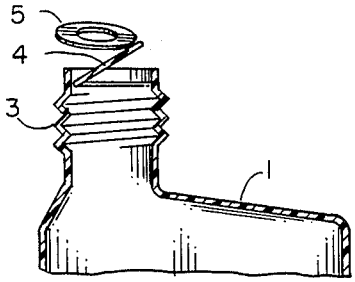
FIG. 6 is a partial sectional view of the bottle of the present invention taken along its midpoint showing an alternate form of the invention in which the ring used for removal of the seal is attached directly to the seal.

Yet another variation on the present invention is shown in FIG. 6 wherein the ring 5 is attached directly to seal 4. Operation, of course, is similar to that previously described.

Figure 7:
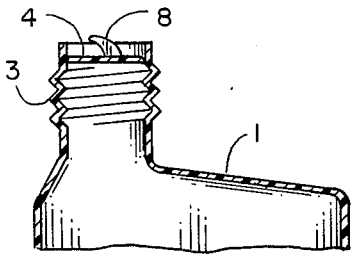
FIG. 7 is a partial sectional view of another alternate form of the invention taken along the midpoint of the bottle wherein a cantilever lever is utilized to depress or lift and rupture the seal of the bottle in accordance with the present invention.
Figure 8:
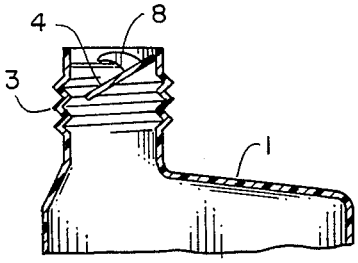
FIG. 8 is a partial sectional view of the bottle of the present invention taken along its midpoint showing the embodiment including the cantilever lever with the seal in an open or ruptured position in accordance with the present invention.

Yet another variation is shown in FIG. 7 in which a small plastic cantilever lever 8 is attached directly to seal 4 and when depressed as shown in FIG. 8 provides the necessary opening through which the oil or similar material contained within the bottle can easily flow when the bottle is placed in the upright position. Alternatively the lever may be lifted to provide the needed opening.

While only a few embodiments of the present have been shown it will be obvious to those skilled in the art that numerous other modifications can be made without departing from the spirit of the invention which shall be limited only by the scope of the claims appended hereto.

What is claimed is:

1. A container for viscous liquid including an elongated neck integral with said container substantially smaller dimensionally than said container, comprising:

a seal located within and attached to said neck, to seal said liquid within said container;

and means located within said neck and attached to said seal, manually operated to detach and remove at least a portion of said seal from within said elongated neck;

whereby said liquid is free to flow out of said container;

and there is further included a cap adapted to be affixed to said neck.

2. A container for viscous liquid as claimed in claim 1 wherein:

said cap includes an area internally in combination with said elongated neck to facilitate storage of said means.

3. A container for viscous liquid as claimed in claim 1 wherein:

said seal is completely detachable from said neck.

4. A container for viscous liquid as claimed in claim 1 wherein:

said seal is partially detachable from said neck.

5. A container for viscous liquid as claimed in claim 1 wherein:

said seal includes a hinge portion separating a first portion of said seal remaining attached within said neck subsequent to operation of said means and a second portion detached from within said neck in response to operation of said means.

6. A container for viscous liquid as claimed in claim 1 wherein:

said means comprise a flexible cord including first and second ends;

said cord first end attached to said seal and said cord second end attached to a ring to facilitate the manual operation of said means.

7. A container for viscous liquid as claimed in claim 1 wherein:

said means comprise a ring attached to said seal to facilitate the manual operation of said means.

8. A container for viscous liquid as claimed in claim 1 wherein:

said means comprise a cantilever lever attached to said seal, manually depressed or in the alternative lifted, to detach at least a portion of said seal from said neck.

* * * * *